US005164288A

United States Patent [19]

Nelson et al.

[11] Patent Number: 5,164,288

[45] Date of Patent: Nov. 17, 1992

[54] PHOTOGRAPHIC ELEMENT CONTAINING PYRAZOLOAZOLE COUPLER AND OXIDIZED DEVELOPER COMPETITOR

[75] Inventors: John V. Nelson, Penfield; Arlyce T. Bowne, Rochester; Terry L. Bistrovich, Victor, all of N.Y.

[73] Assignee: Eastman Kodak Company, Rochester, N.Y.

[21] Appl. No.: 529,290

[22] Filed: May 29, 1990

[51] Int. Cl.[5] ..... G03C 5/50; G03C 7/38; G03C 7/392

[52] U.S. Cl. ..... 430/379; 430/407; 430/409; 430/410; 430/551; 430/558; 430/598

[58] Field of Search ..... 430/551, 558, 264, 598, 430/378, 379, 406, 407, 409, 410, 411

[56] References Cited

U.S. PATENT DOCUMENTS

| | | | |
|---|---|---|---|
| 4,820,616 | 4/1989 | Matejec et al. | 430/543 |
| 4,898,811 | 2/1990 | Wolff et al. | 430/546 |
| 4,923,787 | 5/1990 | Harder | 430/489 |
| 4,952,483 | 8/1990 | Inoue et al. | 430/378 |
| 4,968,592 | 11/1990 | Deguchi et al. | 430/378 |
| 4,971,888 | 11/1990 | Okada et al. | 430/264 |

FOREIGN PATENT DOCUMENTS 0326406 8/1989 European Pat. Off. .

*Primary Examiner*—Lee C. Wright
*Attorney, Agent, or Firm*—Joshua G. Levitt

[57] ABSTRACT

Photographic elements are described having
- a silver halide emulsion layer,
- a pyrazoloazole coupler in reactive association with said silver halide emulsion, and
- a competitor for oxidized developer in reactive association with said coupler having the formula:

$R^1$ represents an electron donating group, $R^2$ represents hydrogen, alkyl, alkoxy, aryl, aryloxy, aralkyl or amino of the formula —$NHR^3$, where $R^3$ is phenyl or benzyl, with the proviso that at least one of the substituents $R^1$ and $R^2$ (a) represents a ballast group of sufficient size as to render the hydrazide compound non-diffusible in the photographic element prior to developement in alkaline processing solution and (b) comprises a polar group, and n is 0, 1 or 2.

14 Claims, No Drawings

PHOTOGRAPHIC ELEMENT CONTAINING PYRAZOLOAZOLE COUPLER AND OXIDIZED DEVELOPER COMPETITOR

FIELD OF THE INVENTION

This invention relates to photography, and specifically to color photographic materials containing pyrazoloazole couplers and hydrazide oxidized color developer competitors.

BACKGROUND OF THE INVENTION

The response of photographic materials to exposure is usually defined by a sensitometric or characteristic curve or set of curves. Such a curve plots image density in the processed material versus the log exposure required to provide that density. The sensitivity, or speed, of a photographic material is a function of the minimum exposure required to provide a detectable change in density compared to density observed in unexposed areas of the material. This is referred to as the threshold speed. In negative photographic materials, the threshold speed is the minimum exposure level required to provide a detectable increase in density compared to the background density observed in unexposed areas of the material. In reversal materials, the threshold speed is the minimum exposure required to provided a detectable decrease in density compared to the maximum density observed in unexposed areas of the material.

The image density of a photographic material can be provided either by metallic silver or by a dye. Coupler compounds are widely used in photographic materials to form dye images by reacting with the oxidation product of silver halide developing agents. Pyrazoloazole coupler compounds are well-known as magenta dye-forming couplers. Such couplers are described in, for example, U.S. Pat. Nos. 4,443,536, 4,665,015, 4,639,415, 4,639,413, 4,559,297, 4,618,573, and 4,762,775.

While pyrazoloazole compounds are useful dye-forming couplers, photographic materials and compositions utilizing them often do not provide as high a threshold speed as might be desired. It is thus an object of this invention to provide higher threshold speed for photographic compositions containing pyrazoloazole coupler compounds.

SUMMARY OF THE INVENTION

According to the present invention, a photographic element contains a silver halide emulsion layer, a pyrazoloazole coupler in reactive association with said silver halide emulsion, and a competitor for oxidized developer in reactive association with said coupler having the formula:

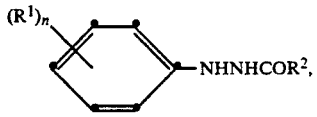

(I)

wherein $R^1$ represents an electron donating group, $R^2$ represents hydrogen, alkyl, alkoxy, aryl, aryloxy, aralkyl or amino of the formula $-NHR^3$, where $R^3$ is phenyl or benzyl, with the proviso that at least one of the substituents $R^1$ and $R^2$ (a) represents a ballast group of sufficient size as to render the hydrazide compound non diffusible in the photographic element prior to development in alkaline processing solution and (b) comprises a polar group, and n is 0, 1 or 2.

The photographic element of the invention provides magenta dye images in response to exposure with radiation. The element's response to exposure exhibits improved threshold speed compared to prior art pyrazoloazole coupler containing photographic elements.

DESCRIPTION OF THE PREFERRED EMBODIMENTS

According to formula (I), $R^1$ substituents, which are electron donating groups, include alkyl, which can be substituted or unsubstituted, straight or branched chain, having from 1 to about 20 carbon atoms, preferably from about 8 to about 16 carbon atoms; alkoxy, which can be substituted or an unsubstituted, straight or branched chain, having from 1 to about 20 carbon atoms, preferably from about 8 to about 16 carbon atoms; carboxy, carbonamido having the formula $-NR^4COR^5$; sulfonamido having the $-NR^4SO_2R^5$; or amino having the formula $-NR^4R^5$ where $R^4$ is hydrogen or alkyl having from 1 to about 8 carbon atoms and $R^5$ is as defined for $R^4$ or is a benzyl or a phenyl group which may be substituted.

$R^2$ substituents that are alkyl or alkoxy can be as defined for these same substituents in $R^1$, or $R^2$ can be substituted or unsubstituted aryl or substituted or unsubstituted aryloxy having from 6 to about 30 carbon atoms, such as phenyl, phenoxy, naphthyl or naphthoxy.

When $R^2$ represents phenyl or phenoxy it is preferred that the aryl ring have a hydrogen bonding substituent in a position ortho to the point of attachment of the carbonyl group to a hydrazide nitrogen atom. Preferred hydrogen bonding groups include hydroxy, primary or secondary amino groups of the formula $-NR^4R^5$, sulfonamido of the formula $-NHSO_2R^4$, carbonamido of the formula $-NR^4COR^5$ and ureido of the formula $-NHCONHR^4$ where $R^4$ and $R^5$ can be hydrogen or alkyl of from 1 to about 8 carbon atoms and $R^5$ is as defined for $R^4$ or a benzyl or phenyl group.

These groups can also be present as substituents on $R^2$ alkyl groups or on other positions of $R^2$ aryl groups.

A polar group which can represent $R^1$ or $R^2$ can be a single group or a combination of groups which have a $\pi$ constant which is more negative than $-1.0$. The $\pi$ constant is defined by C. Hansch, A. Leo, S. Unger, K. Hwan Kim, D. Nikaitani and E. T. Lien, in *JOURNAL OF ORGANIC CHEMISTRY*, 11, 1973 (pp. 1207-1216). The $R^1$ or $R^2$ polar group or groups include, but are not limited to, $-NHSO_2CH_3$, $-NHSO_2$aryl,

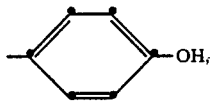

$-CH_2OH$, $-NH_2$, $-COOH$, $-CONH_2$, $-NHCONH_2$, $-NHCSNH_2$, $-N^{30}(R^5)_3$, $-SO_3^-$, $-SO_2^{31}$ and

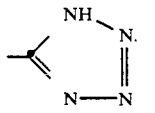

These groups tend to increase the surfactant nature of the hydrazine during alkaline processing.

The alkyl, alkoxy, aryl, aryloxy, aralkyl and benzyl groups which are represented by one or more of $R^1$, $R^2$, $R^3$, $R^4$ and $R^5$ can be substituted with halogen atoms, for example chlorine, or with haloalkyl groups, for example trifluoromethyl, or with

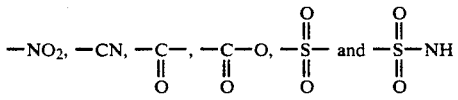

Typical compounds which fall within the above-presented structural formula include:

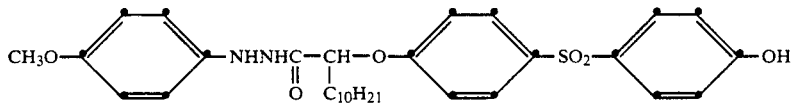

(I-1)

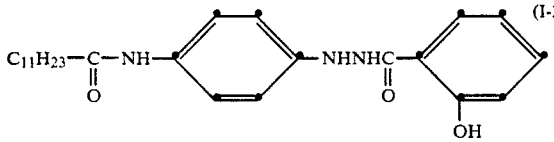

(I-2)

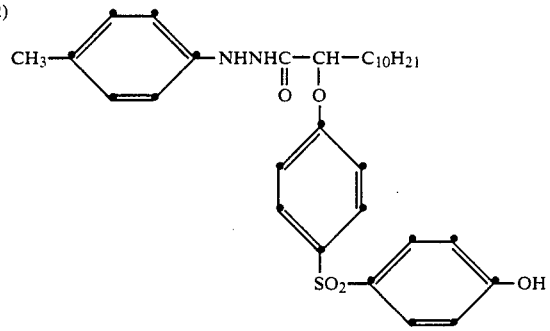

(I-3)

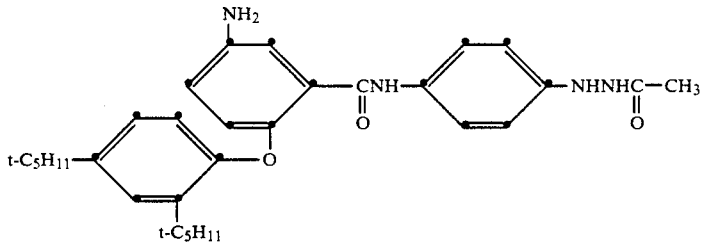

(I-4)

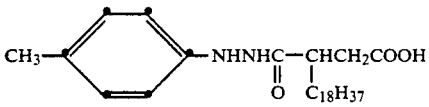

(I-5)

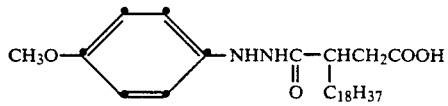

(I-6)

Other compounds according to formula (I), and methods of their synthesis, are described in U.S. application No. 07/351,515, the disclosure of which is incorporated herein by reference.

Pyrazoloazole couplers as a class are well-known to one skilled in the art. Pyrazoloazole couplers useful in the practice of the invention include those according to the formula:

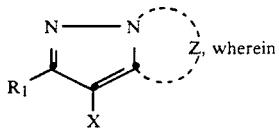

(II)

$R_1$ represents hydrogen or a substituent,

X represents hydrogen or a group capable of being released by a coupling reaction with an oxidized aromatic primary amine developing agent, and Z represents the non metallic atoms necessary to complete a heterocyclic ring.

A more specific expression of compounds according to formula (II) is made by reference to formula (III):

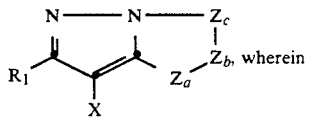

(III)

$R_1$ represents hydrogen or a substituent,

X represents hydrogen or a group capable of being released by a coupling reaction with an oxidized aromatic primary amine developing agent, $Z_a$, $Z_b$, and $Z_c$ each represents a substituted or unsubstituted methine group, =N—, or —NH—, one of either the $Z_a$—$Z_b$ bond or the $Z_b$—$Z_c$ bond is a double bond with the other being a single bond, when the $Z_b$—$Z_c$ bond is a carbon-carbon double bond, it may form part of an aromatic ring, and when any one of $R_1$, X, and a substituted methine group represented by $Z_a$, $Z_b$, or $Z_c$ is a divalent or polyvalent group, it may form a dimer or a polymer.

Examples of substituents useful as $R_1$ are as described below for $R^2$.

X represents a hydrogen atom or a group capable of being released by a coupling reaction with an oxidized aromatic primary amine developing agent (hereinafter referred to as a coupling-off group). Coupling Off groups are known in the art and may include a group containing an aliphatic group, an aromatic group, a heterocyclic group, an aliphatic, aromatic, or heterocyclic sulfonyl group, or an aliphatic, aromatic, or heterocyclic carbonyl group that is bonded to the coupling active carbon via an oxygen atom, a nitrogen atom, a sulfur atom, or a carbon atom, a halogen atom, an aromatic azo group, and the like. The aliphatic, aromatic, or heterocyclic group contained in such coupling-off groups may have one or more substituents, as described below for $R_2$, $R_3$, or $R_4$.

Examples of coupling-off groups include a halogen atom (e.g., fluorine, chlorine, bromine), an alkoxy group (e.g.. ethoxy, dodecyloxy, carboxypropyloxy), an aryloxy group (e.g., 4-chlorophenoxy group, a 4-methoxyphenoxy group), an acyloxy group (e.g., an acetoxy group, a tetradecanoyloxy group), an aliphatic or aromatic sulfonyloxy group (e.g., a methanesulfonyloxy group, a toluenesulfonyloxy group), an acylamino group (e.g., a dichloroacetylamino group, a trifluoroacetylamino group), an aliphatic or aromatic sulfonamido group (e.g., a methanesulfonamido group, a p-toluenesulfonamide group), an alkoxycarbonyloxy group (e.g., an ethoxycarbonyloxy group, a benzyloxycarbonyloxy group), an aryloxycarbonyloxy group (e.g., a phenoxycarbonyloxy group), an aliphatic, aromatic or heterocyclic thio group (e.g., an ethylthio group, a phenylthio group), a carbamoylamino group (e.g., an N-methlycarbamoylamino group, an N-phenylcarbamoylamino group), a 5-membered or 6-membered nitrogen-containing heterocyclic group (e.g., an imidazolyl group, a pyrazolyl group), an imido group (e.g., a succinimido group, a hydantoinyl group), an aromatic azo group (e.g., a phenylazo group), and the like. Some of these groups may have substituents selected from the enumerated for $R_2$, $R_3$ and $R_4$.

Among the couplers represented by formula (III), preferred compounds include those represented by the formulas (IV-1), (IV-2), (IV-3), (IV-4), (IV-5), and (IV-6):

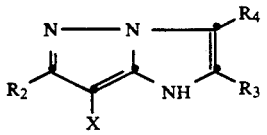
(IV-1)

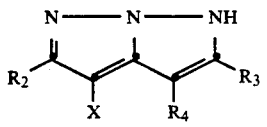
(IV-2)

-continued

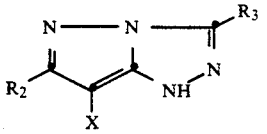
(IV-3)

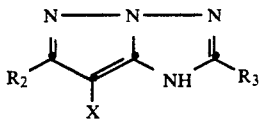
(IV-4)

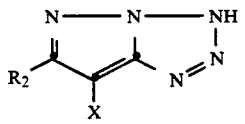
(IV-5)

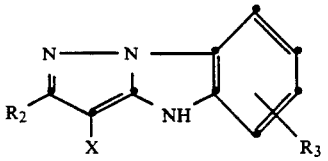
(IV-6)

According to the (IV) formulas shown above, X is as described above for formula (III).

Also according to the (IV) formulas above, $R_2$,$R_3$, and $R_4$ each independently represents a hydrogen atom, a substituted Or unsubstituted alkyl group, (e.g., a methyl group, a propyl group, a t-butyl group, a trifluoromethyl group, a tridecyl group, a 3-(2,4-di-t-amylphenoxy) propyl group), a substituted or unsubstituted aryl group (e.g., a phenyl group, a 4-t-butylphenyl group, a 2,4,6-trimethylphenyl group), a substituted or unsubstituted heterocyclic group (e.g., a 2-furyl group, a 2-thienyl group), a cyano group, a substituted or unsubstituted alkoxy group (e.g., a methoxy group, an ethoxy group), a substituted or unsubstituted aryloxy group (e.g., a phenoxy group, a 2-methylphenoxy group), a substituted or unsubstituted heterocyclic oxy group (e.g., a 2-benzimidazolyloxy group), a substituted or unsubstituted acyloxy group (e.g., an acetoxy group, a hexadecanoyloxy group), a substituted or unsubstituted carbamoyloxy group (e.g., an N-phenylcarbamoyloxy group, an N-ethylcarbamoyloxy group), a substituted or unsubstituted silyloxy group (e.g., a trimethylsilyloxy group), a substituted or unsubstituted sulfonyloxy group (e.g., a dodecylsulfonyloxy group), a substituted or unsubstituted acylamino group (e.g., an acetamido group, a benzamido group), a substituted or unsubstituted anilino group (e.g., a phenylamino group, a 2-chloroanilino group), a substituted or unsubstituted ureido group (e.g., a phenylureido group, a methylureido group), a substituted or unsubstituted imido group (e.g., an N-succinimido group, a 3-benzylhydantoinyl group), a substituted or unsubstituted sulfamoylamino group (e.g., an N,N-dipropylsulfamoylamino group, an N-methyl-N-decylsulfamoylamino group), a substituted or unsubstituted carbamoylamino group (e.g., an N-butylcarbamoylamino group, an N,N-dimethylcarbamoylamino group), a substituted or unsubstituted alkylthio group (e.g., a methylthio group, an octylthio group), a substituted or unsubstituted arylthio group (e.g., a phenylthio group, a 2-butoxy-5-t-octylphenylthio group), a substituted or unsubstituted heterocyclic thio group (e.g., a 2-benzothiazolyl group), a substituted or unsubstituted alkoxycarbonylamino group (e.g., a methoxycarbonylamino group, a tetradecyloxy carbonylamino group), a substituted or unsubstituted aryloxycarbonylamino group (e.g., a phenoxycarbonylamino group, a 2,4-di-tert-butylphenoxycaronylamino group), a substituted or unsubstituted sulfonamido group (e.g., a methanesulfonamido group, a hexadecanesulfonamido group), a substituted or unsubstituted carbamoyl group (e.g., a N-ethylcarbamoyl group, an N,N-dibutylcarbamoyl group), a substituted or unsubstituted acyl group (e.g., an acetyl group, a (2,4-di-tert-amylphenoxy)acetyl group), a substituted or unsubstituted sulfamoyl group (e.g., an N-ethylsulfamoyl group, an N,N-dipropylsulfamoyl group), a substituted or unsubstituted sulfonyl group (e.g., a methanesulfonyl group, an octanesulfonyl group), a substituted or unsubstituted sulfinyl group (e.g., an octanesulfinyl group, a dodecylsulfinyl group), a substituted or unsubstituted alkoxycarbonyl group (e.g., a methoxycarbonyl group, a butyloxycarbonyl group), a substituted or unsubstituted aryloxycarbonyl group (e.g., a phenyloxycarbonyl group, a 3-pentadecyloxycarbonyl group), a substituted or unsubstituted alkenyl group, a substituted or unsubstituted carboxyl group, a substituted or unsubstituted sulfo group, a hydroxyl group, a substituted or unsubstituted amino group, or a substituted or unsubstituted carbonamido group. The substituents for these groups include a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfonylamino group a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, a hydroxyl group, an amino group, and a carbonamido group, etc. $R_2$, $R_3$ and $R_4$ each preferably represents an alkyl group, an aryl group, a carbonamido group, a sulfonamido group or a ureido group.

When the formula (IV-6) contains two or more $R_3$ substituents, they may be the same or different.

In a preferred embodiment, the pyrazoloazole coupler used in the practice of the invention is a pyrazolotriazole coupler. A particularly preferred pyrazolotriazole coupler is one according to formula (IV)-3 above. Another preferred pyrazolotriazole coupler is one according to formula (IV)-4 above.

Examples of pyrazoloazole couplers useful in the practice of the invention include:

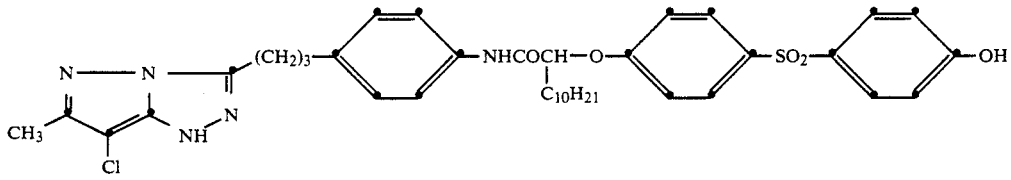

(II-1)

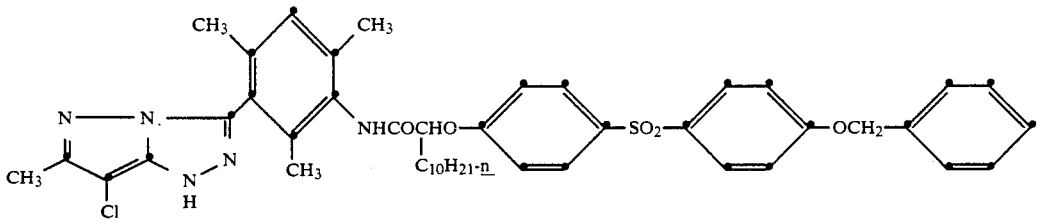

(II-2)

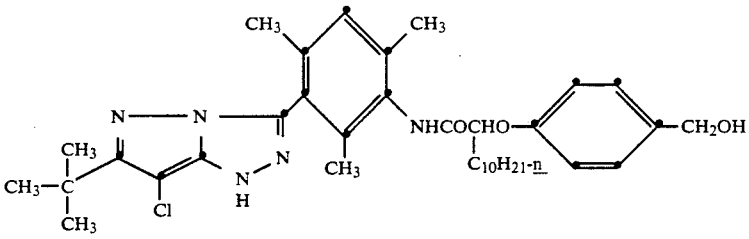

(II-3)

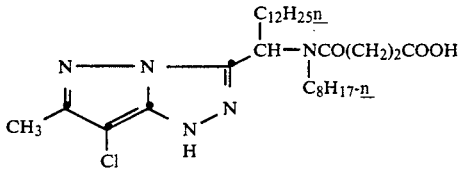

(II-4)

-continued

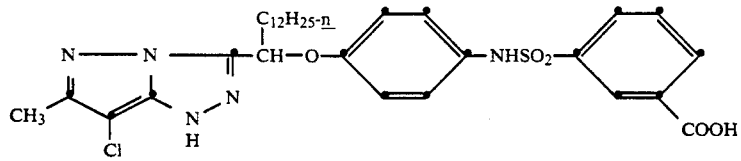

(II-5)

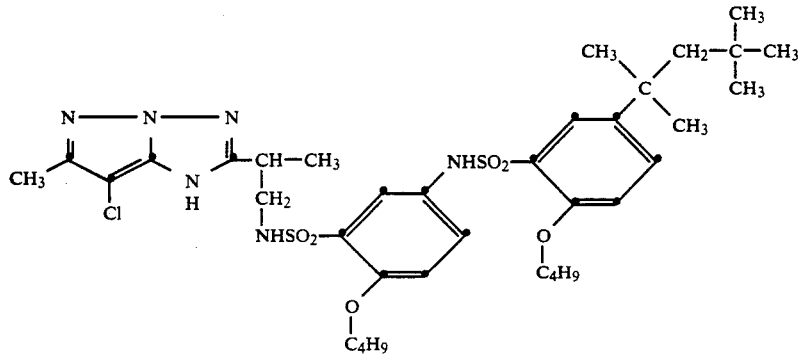

(II-6)

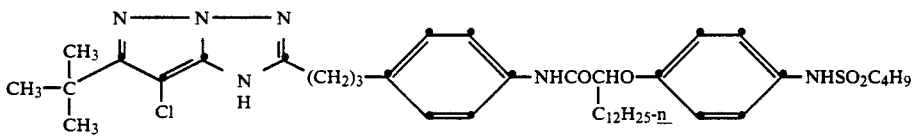

(II-7)

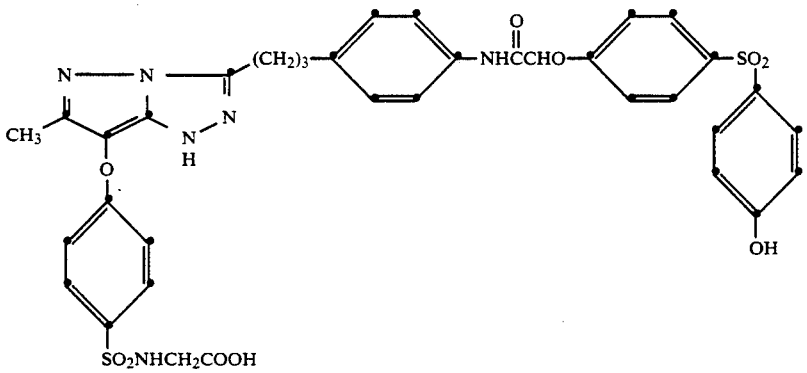

(II-8)

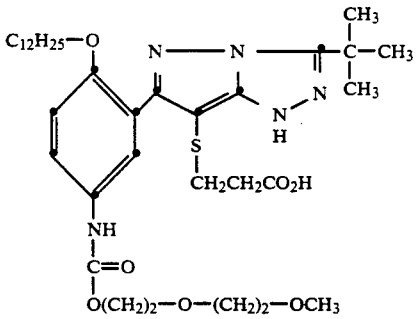

(II-9)

Other pyrazoloazole couplers useful in the practice of the invention are described in U.S. Pat. No. 4,762,775, the disclosure of which is incorporated herein by reference.

The photographic element of the invention may be a negative or a reversal element. In a preferred embodiment of the invention, the photographic element is a color reversal material, such as those that are processable in Kodak E-6® processing (e.g., Kodak Ektachrome® products, Fuji Fujichrome® products). E-6® processing is described in *British Journal of Photography Annual,* 1977, pp. 194–197.

The support of the element of the invention can be any of a number of well known supports for photographic elements. These include polymeric films such as cellulose esters (e.g., cellulose triacetate and diacetate) and polyesters of dibasic aromatic carboxylic acids with divalent alcohols (e.g., poly(ethylene terephthalate)), paper, and polymer-coated paper. Such supports are described in further detail in *Research Disclosure,* December, 1989, Item 308119 [hereinafter referred to as *Research Disclosure I*], Section XVII.

The silver halide emulsion used in the practice of the invention can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Silver halide emulsions and their preparation are further described in *Research Disclosure I*, Section I. Also useful are tabular grain silver halide emulsions, as described in *Research Disclosure*, January, 1983, Item 22534 and U.S. Pat. No. 4,425,426.

The pyrazoloazole coupler (or mixtures of such couplers) and the competitor of formula (I) (or mixtures of such competitors) used in the practice of the invention can be incorporated in hydrophilic layers of photographic materials by techniques well known in the art. One common technique involves the use of high-boiling water immiscible organic solvents and/or surfactants. Useful organic solvents include tricresyl phosphates, di-n-butyl phthalate, and others described in *Research Disclosure I*, Section XIV. Surfactants are well-known to one skilled in the art, and are described in *Research Disclosure I*, Section XI. Mixtures of solvents and surfactants may also be used.

The silver halide described above can be sensitized to a particular wavelength range of radiation, such as the red, blue, or green portions of the visible spectrum, or to other wavelength ranges, such as ultraviolet, infrared, and the like. In a preferred embodiment, the silver halide emulsion associated with the pyrazoloazole coupler is spectrally sensitized to green light so as to complement the magenta color of the dye formed by the coupler during processing. Chemical sensitization of silver halide can be accomplished with chemical sensitizers such as gold compounds, iridium compounds, or other group VIII metal compounds. Spectral sensitization is accomplished with spectral sensitizing dyes such as cyanine dyes, merocyanine dyes, styryls, or other known spectral sensitizers. Additional information on sensitization of silver halide is described in *Research Disclosure I*, Sections I–IV.

The photographic element of the invention may be a color element or monochromatic. Multicolor photographic elements according to the invention generally comprise a blue-sensitive silver halide layer having a yellow color-forming coupler associated therewith, a green sensitive layer having a magenta color-forming coupler associated therewith, and a red-sensitive silver halide layer having a cyan color-forming coupler associated therewith. Color photographic elements and color-forming couplers are well known in the art and are further described in *Research Disclosure I*. Section VII.

The element of the invention can also include any of a number of other well-known additives and layers, as described in *Research Disclosure I*. These include, for example, optical brighteners, antifoggants, oxidized developer scavengers (which can be the same as or different than the competitor according to formula (I)), development accelerators, image stabilizers, light absorbing materials such as filter layers or intergrain absorbers, light scattering materials, gelatin hardeners, coating aids and various surfactants, overcoat layers, interlayers and barrier layers, antistatic layers, plasticizers and lubricants, matting agents, development inhibitor releasing couplers, bleach accelerator releasing couplers, and other additives and layers known in the art.

The photographic elements of the invention, when exposed, are processed to yield an image. Processing can be by any type of known photographic processing, as described in *Research Disclosure I*. Sections XIX--XXIV. A negative image can be developed by color development with a chromogenic developing agent followed by bleaching and fixing. A positive image can be developed by first developing with a non chromogenic developer, then uniformly fogging the element, and then developing with a chromogenic developer.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium of potassium salts of ferric ethylenediaminetetraacetic acid), water soluble persulfates (e.g., potassium, sodium, or ammonium persulfate), water soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The invention is further illustrated by the following Example:

Example 1

Photographic elements were prepared by coating a cellulose triacetate film support with a photosensitive layer containing a silver bromoiodide emulsion at 0.81 g Ag/m$^2$, gelatin at 2.16 g/m$^2$, and one of the couplers identified in Table I dispersed in one-half its weight of tricresyl phosphate and coated at 1.84 mmoles/m$^2$. When one of the competitors in Table I was added to the coating, it was coated at the relative molar laydown as listed in Table I compared to the coupler in the same coating. The photosensitive layer was overcoated with a layer containing gelatin at 2.16 g/m$^2$ and 1,1'-[methylenebis(sulfonyl)]bis-ethene at 1.75 weight percent based on total gelatin.

Samples of each element were imagewise exposed through a graduated density test object and processed using standard Kodak E-6® processing solutions and methods, with a shortened first development time of 4 minutes. The spectral dye density curves of the samples were measured over a range from 400 nm to 700 nm from a patch with density closest to 1.0, and the resulting data was normalized to a density of 1.0 at λmax. From these curves, the spectral absorption at 430 nm was determined.

Comparative Coupler A

-continued
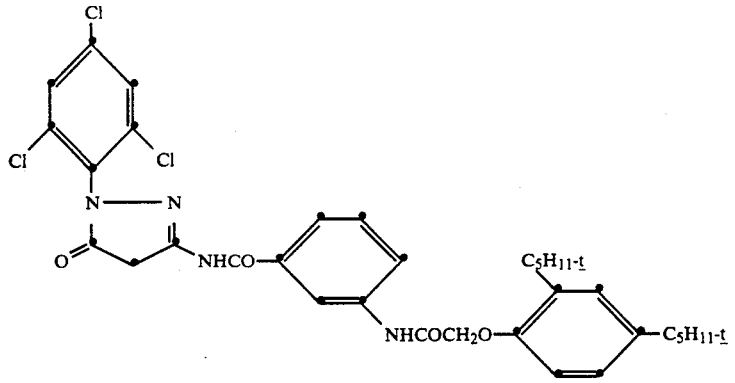
Inventive Coupler 1
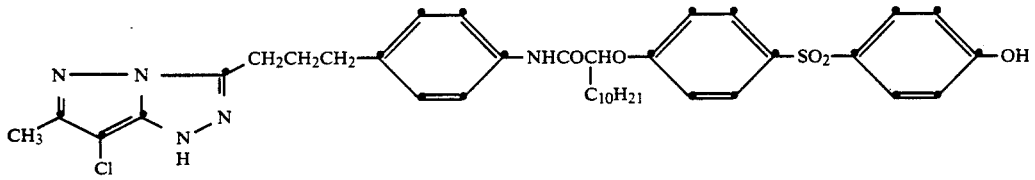
Inventive Coupler 2
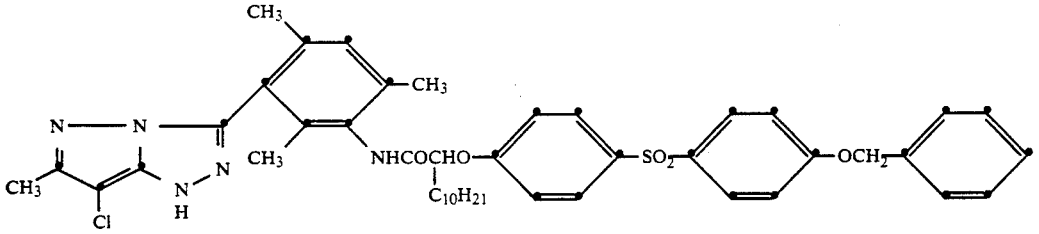
Comparative Competitor A
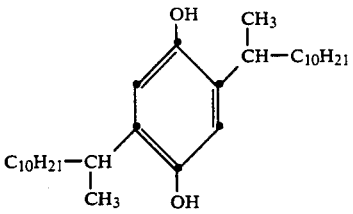
Comparative Competitor B
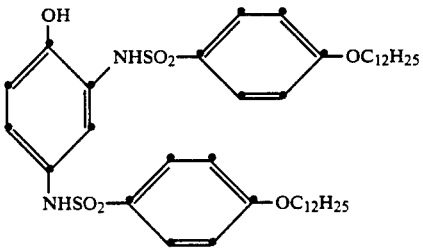
Inventive Competitor 1

-continued

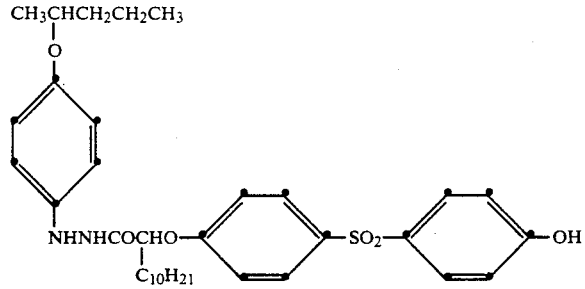

| Comparison or Invention | Coupler | Competitor | Coated Competitor Level Compared To Coupler Level | Change in Threshold Speed Compared To No Competitor In Coating | Density at 430 nm |
|---|---|---|---|---|---|
| C | A | B | 25 mole % | 0 | 0.19 |
| C | A | 1 | 25 mole % | 0 | 0.15 |
| C | 1 | B | 25 mole % | +0.31 logE | 0.08 |
| I | 1 | 1 | 25 mole % | +0.20 logE | 0.03 |
| C | 2 | A | 10 mole % | 0 | 0 |
| C | 2 | A | 25 mole % | 0 | 0 |
| C | 2 | B | 10 mole % | 0 | 0.10 |
| C | 2 | B | 25 mole % | 0 | 0.29 |
| I | 2 | 1 | 10 mole % | +0.05 logE | 0.03 |
| I | 2 | 1 | 25 mole % | +0.07 logE | 0.04 |

As shown in the table, only the combined use of the couplers of the invention with the competitors of the invention provide increased speed without the generation of unwanted dye contamination in the blue density region of the spectrum.

The invention has been described in detail with particular reference to preferred embodiments thereof, but it will be understood that variations and modifications can be effected within the spirit and scope of the invention.

What is claimed is:

1. A color reversal photographic element comprising a support having thereon a silver halide emulsion layer, a pyrazoloazole coupler in reactive association with said silver halide emulsion, and a dispersion in a high boiling point, water immiscible organic solvent of a competitor for oxidized developer in reactive association with said coupler; said competitor having the formula:

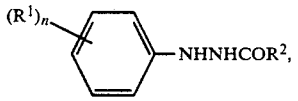

$R^1$ represents an electron donating group selected from:

unsubstituted alkyl or unsubstituted alkoxy of from about 8 to about 16 carbon atoms, amino of the formula $—NR^4R^5$, sulfonamido of the formula $—NR^4SO_2R^5$ and carbonamido of the formula $—NR^4CO_2R^5$, where $R^4$ is hydrogen or unsubstituted alkyl of from 1 to about 8 carbon atoms and $R^5$ is as defined for $R^4$ or is unsubstituted benzyl or unsubstituted phenyl;

$R^2$ represents hydrogen, alkyl, alkoxy, aryl, aryloxy, aralkyl or amino of the formula $—NHR^3$, where $R^3$ is phenyl or benzyl, with the proviso that at least one of the substituents $R^1$ and $R^2$ (a) represents a ballast group of sufficient size as to render the hydrazide compound non-diffusible in the photographic element prior to development in alkaline processing solution and (b) comprises a polar group, and n is 0, 1, or 2.

2. A photographic element according to claim 1 wherein said coupler has the formula:

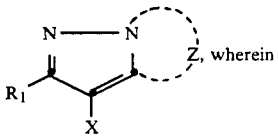

$R_1$ represents hydrogen or a substituent,

X represents hydrogen or a group capable of being released by a coupling reaction with an oxidized aromatic primary amine developing agent, and Z represents the non-metallic atoms necessary to complete a heterocyclic ring.

3. A photographic element according to claim 1 wherein said coupler has the formula:

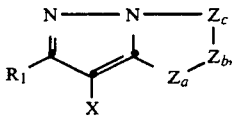

$R_1$ represents hydrogen or a substituent,

X represents hydrogen or a group capable of being released by a coupling reaction with an oxidized aromatic primary amine developing agent, $Z_a$,$Z_b$, and $Z_c$ each represent a substituted or unsubstituted methine group, =N—, or —NH—, one of either the $Z_a$—$Z_b$ bond or the $Z_b$—$Z_c$ bond is a double bond with the other being a single bond, when the $Z_b$—$Z_c$ bond is a carbon-carbon double bond, it may form part of an aromatic ring, and when any one of $R_1$, X, and a substituted methine group represented by $Z_a$,$Z_b$, or $Z_c$ is a divalent or polyvalent group, it may form a dimer or a polymer.

4. A photographic element according to claim 1 wherein said coupler is selected from the group consisting of:

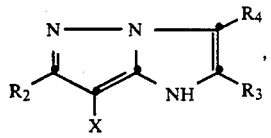

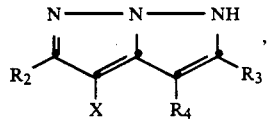

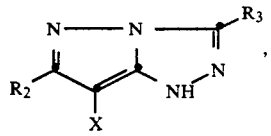

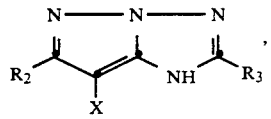

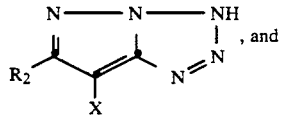
, and

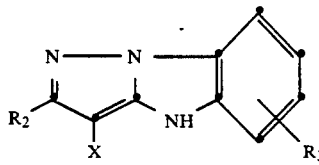
, wherein

X represents hydrogen or a group capable of being released by a coupling reaction with an oxidized aromatic primary amine developing agent, and $R_1$, $R_2$, $R_3$ and $R_4$ each independently represents a hydrogen atom a substituted or unsubstituted alkyl group, a substituted or unsubstituted aryl group, a substituted or unsubstituted heterocyclic group, a cyano group, a substituted or unsubstituted alkoxy group, a substituted or unsubstituted aryloxy group, a substituted or unsubstituted heterocyclic oxy group, a substituted or unsubstituted acyloxy group, a substituted or unsubstituted carbamoyloxy group, a substituted or unsubstituted silyloxy group, a substituted or unsubstituted sulfonyloxy group, a substituted or unsubstituted acylamino group, a substituted or unsubstituted anilino group, a substituted or unsubstituted ureido group, a substituted or unsubstituted imido group, a substituted or unsubstituted sulfamoylamino group, a substituted or unsubstituted carbamoylamino group, a substituted or unsubstituted alkylthio group, a substituted or unsubstituted arylthio group, a substituted or unsubstituted heterocyclic thio group, a substituted or unsubstituted alkoxycarbonylamino group, a substituted or unsubstituted aryloxycarbonylamino group, a substituted or unsubstituted sulfonamido group, a substituted or unsubstituted carbamoyl group, a substituted or unsubstituted acyl group, a substituted or unsubstituted sulfamoyl group, a substituted or unsubstituted sulfonyl group, a substituted or unsubstituted sulfinyl group, a substituted or unsubstituted alkoxycarbonyl group, a substituted or unsubstituted aryloxycarbonyl group, a substituted or unsubstituted alkenyl group, a substituted or unsubstituted carboxyl group, a substituted or unsubstituted sulfo group, a hydroxyl group, a substituted or unsubstituted amino group, or a substituted or unsubstituted carbonamido group; when the formula (IV-6) contains two or more $R_3$ substituents, they may be the same or different, and one of $R_2$,$R_3$, $R_4$ and X may be a divalent or polyvalent group which forms a dimer or a polymer or which can be bonded to a higher molecular weight main chain to form a high molecular weight coupler.

5. A photographic element according to claim 4 wherein said coupler has the formula:

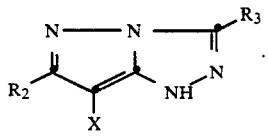

6. A photographic element according to claim 4 wherein said coupler has the formula:

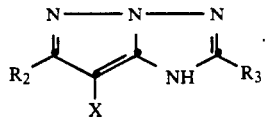

7. A photographic element according to any of claims 1 or 6 wherein said polar group has a $\pi$ constant which is more negative than $-1.0$.

8. A photographic element according to claims 1 or 5 wherein $R^2$ is aryl or aryloxy having from 6 to about 10 ring carbon atoms.

9. A photographic element according to claim 1 wherein $R^2$ is phenyl or phenoxy substituted with a hydrogen bonding group in a position ortho to the point of attachment of the carbonyl group to a hydrazide nitrogen atom.

10. A photographic element according to claim 9 wherein the hydrogen bonding group is hydroxy, primary or secondary amino of the formula $—NR^4R^5$, sulfonamido of the formula $—NHSO_2R^4$, carbonamido of the formula $—NHCOR^4$ or ureido of the formula $—NHCONHR^4$, where $R^4$ is hydrogen or alkyl of from 1 to about 8 carbon atoms and $R^5$ is as defined for $R_4$ or a benzyl or phenyl group.

11. A photographic element according to claim 1, 4, 5, or 6 wherein said coupler and said competitor are in said silver halide emulsion layer.

12. A color reversal photographic element comprising a support having thereon a silver halide emulsion layer, a pyrazoloazole coupler in reactive association with the silver halide emulsion, the coupler having one of the formulae:

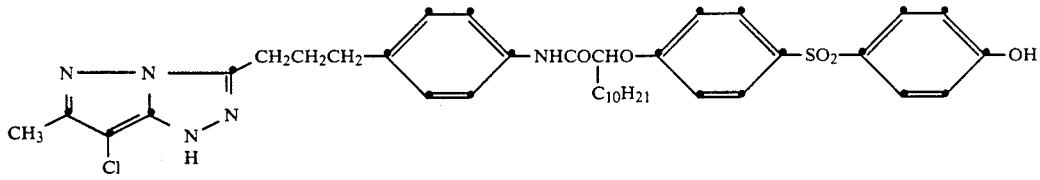

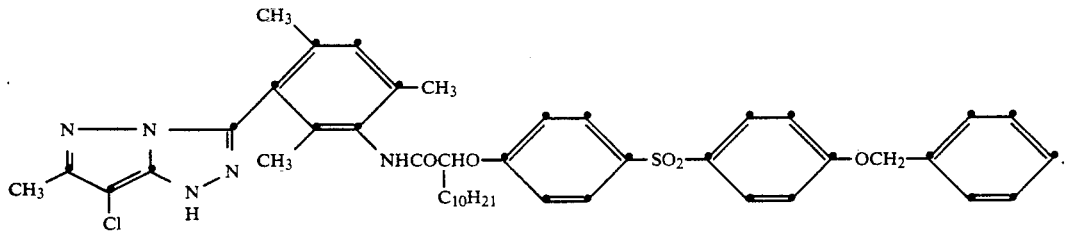

and a competitor for oxidized developer in reactive association with the coupler, the competitor having the formula:

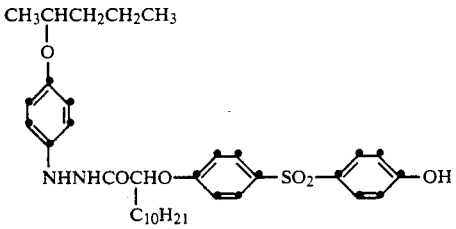

13. A color reversal processing method comprising the steps of developing a photographic method with a non-chromogenic developer, then uniformly fogging the element, and then developing with a chromogenic developer, wherein said element comprises a support having thereon a silver halide emulsion layer, a pyrazoloazole coupler in reactive association with said silver halide emulsion, and a competitor for oxidized developer in reactive association with said coupler having the formula:

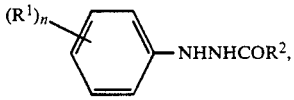

$R^1$ represents an electron donating group, $R^2$ represents hydrogen, alkyl, alkoxy, aryl, aryloxy, aralkyl or amino or the formula —$NHR^3$, where $R^3$ is phenyl or benzyl, with the proviso that at least one of the substituents $R^1$ and $R^2$ (a) represents (1) a ballast group of sufficient size as to render the hydrazide compound non-diffusible in the photographic element prior to development in alkaline processing solution and (b) comprises a polar group, and n is 0, 1, and 2.

14. A processing method according to claim 13 wherein said coupler and said competitor are in said silver halide emulsion layer.

* * * * *

UNITED STATES PATENT AND TRADEMARK OFFICE

CERTIFICATE OF CORRECTION

PATENT NO. : 5,164,288

DATED : November 17, 1992

INVENTOR(S) : John V. Nelson, et al

It is certified that error appears in the above-indentified patent and that said Letters Patent is hereby corrected as shown below:

Col 15, line 50, after "," insert --wherein--.

Col 18, line 41, after "1" insert --, 5--.

Col 18, line 58, delete "$R_4$" and insert --$R^4$--.

Col 19, line 27, line in formula "$CH_3CHCH_2CH_2CH_3$" should read --$CH_3CH\ CH_2CH_2CH_3$.

Col 20, line 27, after "," insert --wherein--.

Col 20, line 40, delete "and" and insert --or--.

Signed and Sealed this

Fourteenth Day of December, 1993

*Attest:*

*Attesting Officer*

BRUCE LEHMAN

*Commissioner of Patents and Trademarks*